US011600416B1

(12) United States Patent
Jan et al.

(10) Patent No.: US 11,600,416 B1
(45) Date of Patent: Mar. 7, 2023

(54) CRYOGEN-FREE HIGH-TEMPERATURE SUPERCONDUCTOR UNDULATOR STRUCTURE AND METHOD FOR MANUFACTURING THE SAME

(71) Applicant: NATIONAL SYNCHROTRON RADIATION RESEARCH CENTER, Hsinchu (TW)

(72) Inventors: Jyh-Chyuan Jan, Hsinchu (TW); Chi-Chuan Tsai, Hsinchu (TW); Fu-Yuan Lin, Hsinchu (TW); Ching-Shiang Hwang, Hsinchu (TW)

(73) Assignee: NATIONAL SYNCHROTRON RADIATION RESEARCH CENTER, Hsinchu (TW)

( * ) Notice: Subject to any disclaimer, the term of this patent is extended or adjusted under 35 U.S.C. 154(b) by 25 days.

(21) Appl. No.: 17/403,037

(22) Filed: Aug. 16, 2021

(51) Int. Cl.

| | |
|---|---|
| ***H01F 6/06*** | (2006.01) |
| ***H05H 7/04*** | (2006.01) |
| ***H01F 41/04*** | (2006.01) |
| ***H01F 27/26*** | (2006.01) |

(52) U.S. Cl.
CPC ..... *H01F 6/06* (2013.01); *H01F 27/263* (2013.01); *H01F 41/048* (2013.01); *H05H 7/04* (2013.01); *H05H 2007/041* (2013.01)

(58) Field of Classification Search
CPC ..... H05H 7/04; H05H 2007/041; H01F 6/06; H01F 27/263; H01F 41/048
See application file for complete search history.

(56) References Cited

U.S. PATENT DOCUMENTS

| | | | |
|---|---|---|---|
| 8,849,364 | B2 | 9/2014 | Boffo et al. |
| 10,249,420 | B2 | 4/2019 | Kesgin et al. |
| 2013/0130914 | A1 | 5/2013 | Boffo et al. |
| 2017/0162309 | A1 | 6/2017 | Kesgin et al. |

FOREIGN PATENT DOCUMENTS

| | | | |
|---|---|---|---|
| CN | 107077944 B | 5/2020 | |
| WO | WO-2010046068 A1 * | 4/2010 | ..... H05H 13/04 |

OTHER PUBLICATIONS

Non-final Office Action and search report of of TW family patent Application No. 110139894, dated Apr. 26, 2022, w/English-language translation, 9 pages.

* cited by examiner

*Primary Examiner* — Mohamad A Musleh
(74) *Attorney, Agent, or Firm* — Muncy, Geissler, Olds & Lowe, P.C.

(57) ABSTRACT

A cryogen-free high-temperature superconductor undulator structure is provided. The superconductor undulator structure includes a magnetic core body and a coil structure. The magnetic core body includes a first and a second half magnetic pole arrays that are vertically aligned, a plurality of first winding cores in the first half magnetic pole array, and a plurality of second winding cores in the second half magnetic pole array. The coil structure is wound on the first winding cores and the second winding cores of the magnetic core body. The coil structure includes a plurality of first superconductor tapes in contact with each of the first winding cores and each of the second winding cores, and a plurality of second superconductor tapes, each of the second superconductor tapes is in contact with two adjacent first superconductor tapes. A method of manufacturing a cryogen-free high-temperature superconductor undulator structure is also provided.

20 Claims, 11 Drawing Sheets

CRYOGEN-FREE HIGH-TEMPERATURE SUPERCONDUCTOR UNDULATOR STRUCTURE AND METHOD FOR MANUFACTURING THE SAME

FIELD

The present disclosure relates to a superconductor undulator and a method for manufacturing the same, particularly, the disclosed high-temperature superconductor undulator is free from using cryogen for cooling.

BACKGROUND

A synchrotron light source is a source of electromagnetic radiation (EM) usually produced by a storage ring, for scientific and technical purposes. First observed in synchrotrons, synchrotron light is now produced by storage rings and other specialized particle accelerators, typically accelerating electrons. Once the high-energy electron beam has been generated, it is directed into auxiliary components such as undulators in storage rings and free-electron lasers. These supply the strong alternating magnetic fields perpendicular to the beam which are needed to convert high-energy electrons into photons.

BRIEF DESCRIPTION OF THE DRAWINGS

Aspects of the present disclosure are best understood from the following detailed description when read with the accompanying figures. It is noted that, in accordance with the standard practice in the industry, various structures are not drawn to scale. In fact, the dimensions of the various structures may be arbitrarily increased or reduced for clarity of discussion.

DETAILED DESCRIPTION

Figure 1:
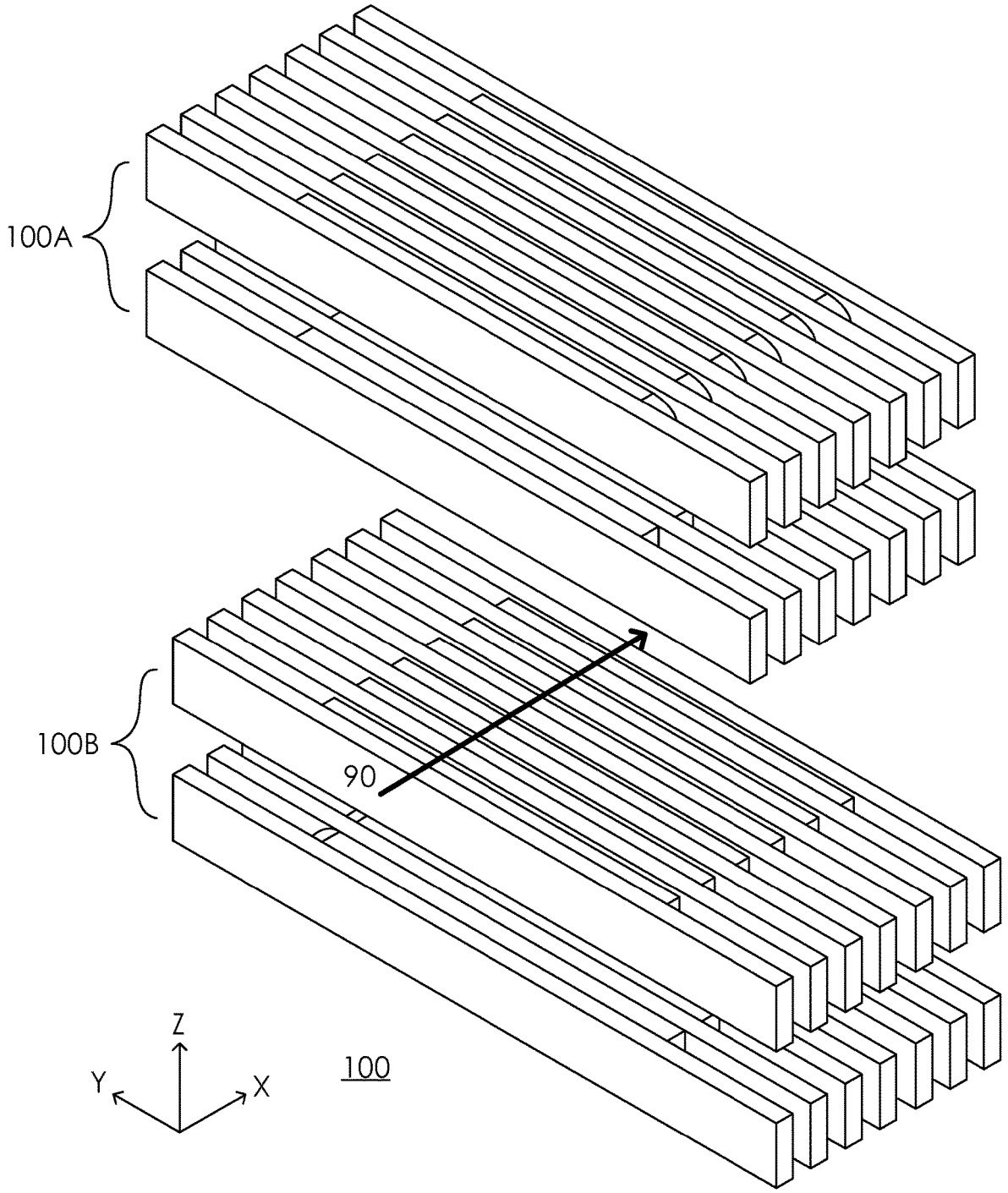
FIG. 1 illustrates a three-dimensional illustration of a magnetic core body according to some embodiments of the present disclosure.

The following disclosure provides many different embodiments, or examples, for implementing different features of the provided subject matter. Specific examples of elements and arrangements are described below to simplify the present disclosure. These are, of course, merely examples and are not intended to be limiting. For example, the formation of a first feature over or on a second feature in the description that follows may include embodiments in which the first and second features are formed in direct contact, and may also include embodiments in which additional features may be formed between the first and second features, such that the first and second features may not be in direct contact. In addition, the present disclosure may repeat reference numerals and/or letters in the various examples. This repetition is for the purpose of simplicity and clarity and does not in itself dictate a relationship between the various embodiments and/or configurations discussed.

Further, spatially relative terms, such as "beneath," "below," "lower," "above," "upper", "on" and the like, may be used herein for ease of description to describe one element or feature's relationship to another element(s) or feature(s) as illustrated in the figures. The spatially relative terms are intended to encompass different orientations of the device in use or operation in addition to the orientation depicted in the figures. The apparatus may be otherwise oriented (rotated 90 degrees or at other orientations) and the spatially relative descriptors used herein may likewise be interpreted accordingly.

As used herein, the terms such as "first", "second" and "third" describe various elements, components, regions, layers and/or sections, these elements, components, regions, layers and/or sections should not be limited by these terms. These terms may be only used to distinguish one element, component, region, layer, or section from another. The terms such as "first", "second", and "third" when used herein do not imply a sequence or order unless clearly indicated by the context.

In an undulator which used to extract synchrotron radiation from an electron beam in a synchrotron radiation facility, there is provided a pair of magnet arrays disposed parallel to and opposite each other to produce a periodic magnetic field, and by undulating electrons that travel between the pair of magnet arrays at a speed close to that of light, intense synchrotron radiation is generated. The periodic magnetic field can be produced with permanent magnets or electromagnets. That is, in general, magnetic fields is generated by permanent magnets or electromagnetic coils such as superconducting coils, and it is known that a superconducting undulator can provide a greater strength of magnetic field than a permanent undulator. However, the superconducting undulators must be operated under an extremely low temperature so far, for example, they must be operated by using liquid helium as a coolant to maintain an operating temperature at about 4.2K only. Such consideration leads to a need to develop a novel superconductor undulator structure that can be operated under an environment that no liquid helium is needed. Therefore, a high temperature superconductor undulator that no longer depending on the supplement of liquid helium is provided in the present disclosure.

FIG. 1 illustrates an upper magnetic core body 100A and a lower magnetic core body 100B of a superconductor undulator module in some embodiments of the present disclosure. The lower magnetic core body 100B is in proximity to a bottom of the upper magnetic core body 100A and thereby vertically aligns to the upper magnetic core body 100A. Accordingly, an electron beam 90 may pass through the gap between the upper magnetic core body 100A and the lower magnetic core body 100B. In order to illustrate the structure details of the upper magnetic core body 100A and the lower magnetic core body 100B, FIGS. 2A to 2C and FIGS. 3A to 3C further show the magnetic core bodies utilized in the present disclosure.

Figure 2A:
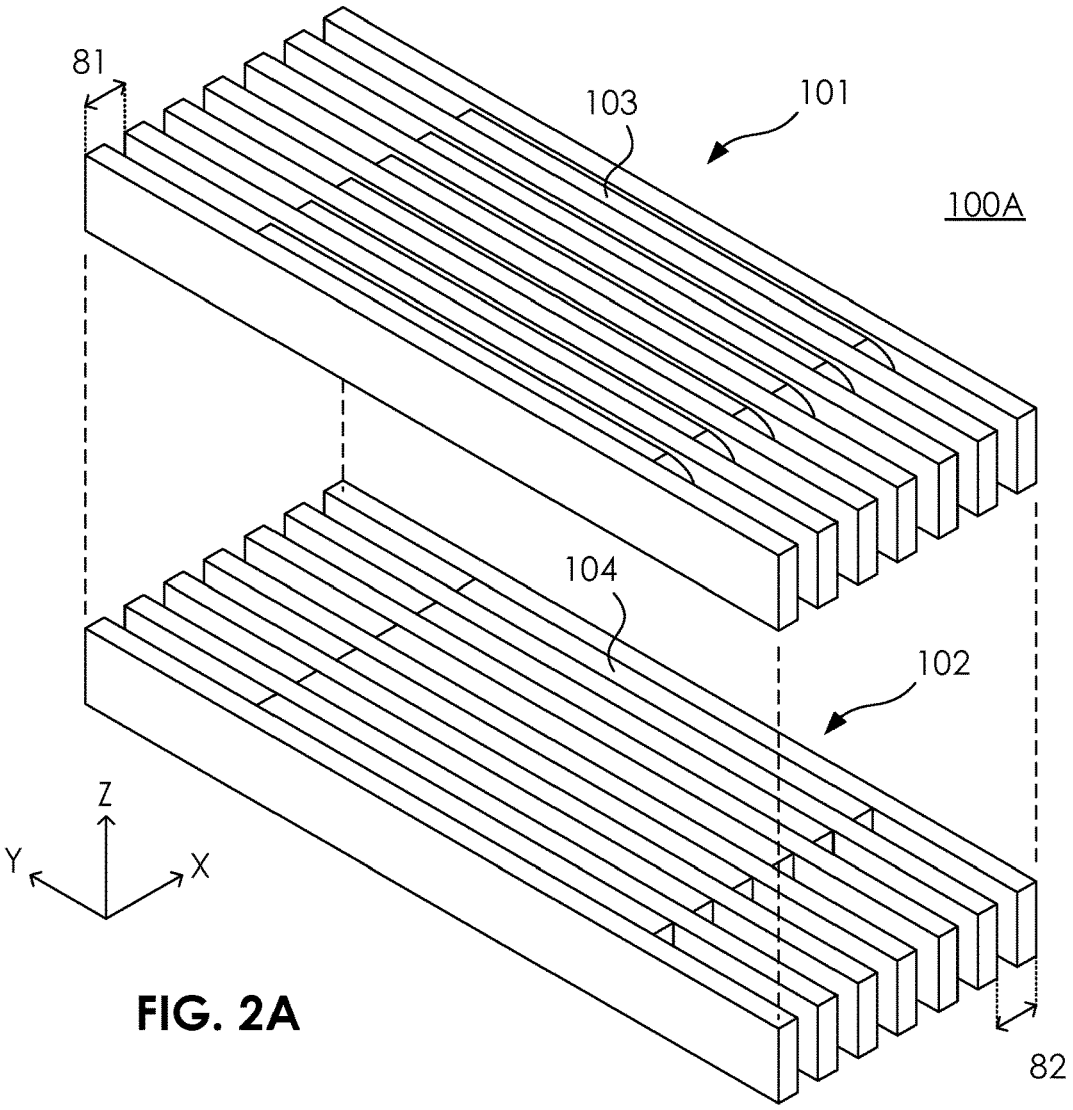
FIG. 2A illustrates a three-dimensional illustration of an upper magnetic core body according to some embodiments of the present disclosure.

Referring to FIG. 2A, in some embodiments, a superconductor undulator structure disclosed in the present disclosure includes the upper magnetic core body 100A, wherein the upper the magnetic core body 100A in the present disclosure is separated into two half arrays. For instance, as shown in the figure, the upper magnetic core body 100A may include a first half magnetic pole array 101 and a second half magnetic pole array 102, while the second half magnetic pole array 102 is vertically aligned to the first half magnetic pole array 101. In some embodiments, the first half magnetic pole array 101 and the second half magnetic pole array 102 of the upper magnetic core body 100A are made of iron or steel.

Since the magnetic core bodies (i.e., the upper magnetic core body 100A and the lower magnetic core body 100B) are utilized to increase the strength of magnetic field in an electromagnetic coil, the magnetic core body 100 in some embodiments of the present disclosure further includes a plurality of winding cores for winding the electromagnetic coil thereon. In some embodiments, as the upper magnetic core body 100A shown in FIG. 2A and the side views of the pole units 81, 82 therein that further shown in FIGS. 2B and 2C, the upper magnetic core body 100A includes a plurality of first winding cores 103 in the first half magnetic pole array 101 and a plurality of second winding cores 104 in the second half magnetic pole array 102. In some embodiments, the first winding cores 103 and the second winding cores 104 are employed to provide grooves for wiring, and therefore, the surfaces of the winding cores may not be coplanar with other portions of the magnetic core body 100.

Figure 2B:
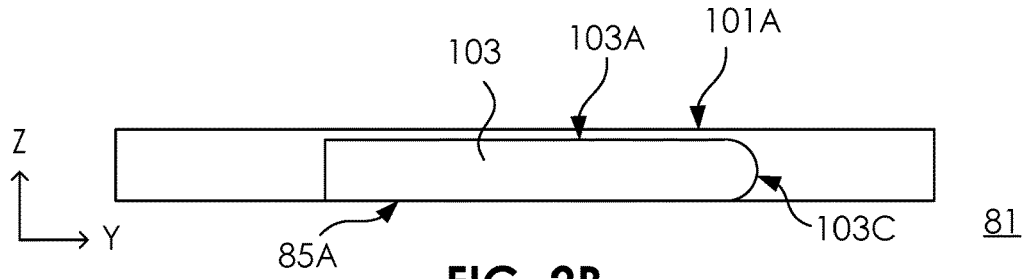
FIG. 2B illustrates a side view of a pole unit according to some embodiments of the present disclosure.
Figure 2C:
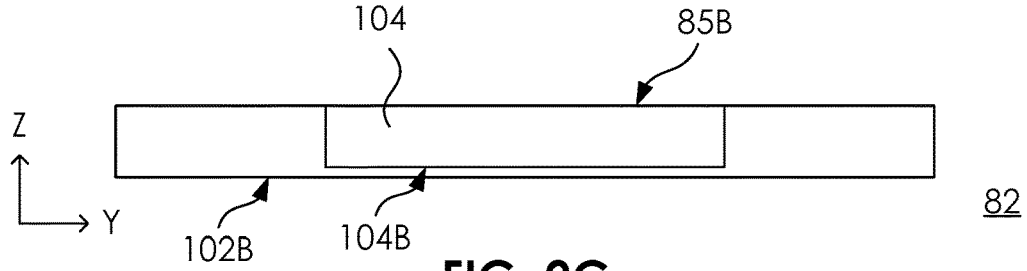
FIG. 2C illustrates a side view of a pole unit according to some embodiments of the present disclosure.

For example, as shown in FIG. 2B, the first winding core 103 in the first half magnetic pole array 101 may have a top surface 103A that slightly lower than a top surface 101A of the first half magnetic pole array 101. Likewise, as shown in FIG. 2C, the second winding core 104 in the second half magnetic pole array 102 may have a bottom surface 104B slightly higher than a bottom surface 102B of the second half magnetic pole array 102. In contrast, the structure features of other sides of the first winding core 103 and the second winding core 104 are different since a metal plate set (will be discussed later in FIG. 7A) is disposed between the first half magnetic pole array 101 and the second half magnetic pole array 102. In such embodiments, the first winding core 103 and the second winding core 104 are both in contact with the metal plate set, thus there is no height difference between the pole units 81 or 82 at the center of the upper magnetic core body 100A. Plan surfaces 85A and 85B may thereby be provided by the pole units 81 and 82, respectively, at the center of the upper magnetic core body 100A for entirely contacting the metal plate set.

Figure 3A:
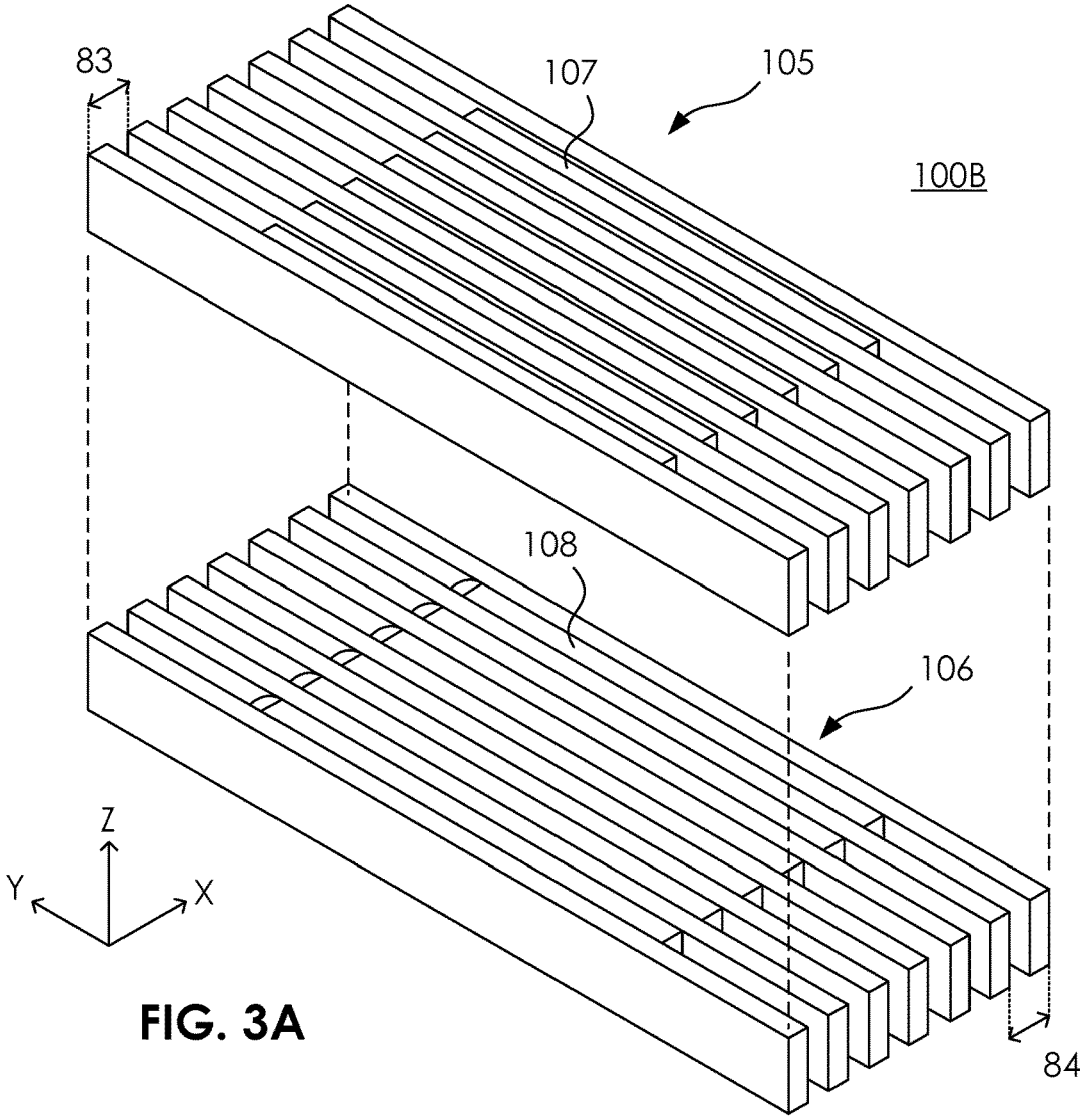
FIG. 3A illustrates a three-dimensional illustration of a lower magnetic core body according to some embodiments of the present disclosure.

Referring to FIG. 3A, in some embodiments, the superconductor undulator structure in the present disclosure includes the lower magnetic core body 100B, wherein the lower magnetic core body 100B in the present disclosure is also separated into two half arrays as that in the upper magnetic core body 100A. As illustrated in the figure, the lower magnetic core body 100B may include a third half magnetic pole array 105 and a fourth half magnetic pole array 106, while the fourth half magnetic pole array 106 is vertically aligned to the third half magnetic pole array 105. In some embodiments, the material of the third half magnetic pole array 105 and the fourth half magnetic pole array 106 of the lower magnetic core body 100B are identical to that of the upper magnetic core body 100A.

Figure 3B:
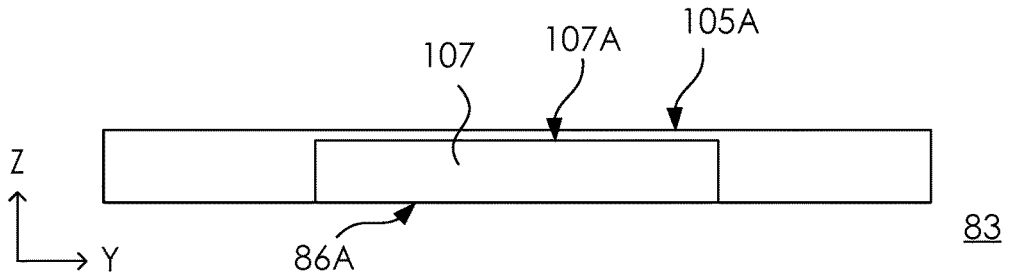
FIG. 3B illustrates a side view of a pole unit according to some embodiments of the present disclosure.
Figure 3C:
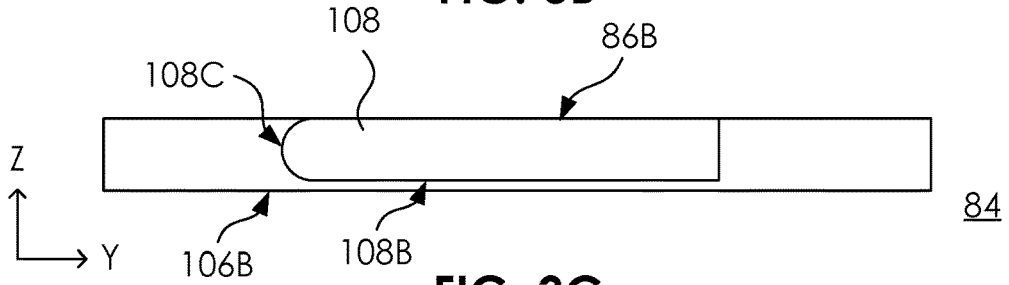
FIG. 3C illustrates a side view of a pole unit according to some embodiments of the present disclosure.

In some embodiments, as the lower magnetic core body 100B shown in FIG. 3A and the side views of the pole units 83, 84 therein that further illustrated in FIGS. 3B and 3C, the lower magnetic core body 100B includes a plurality of third winding cores 107 in the third half magnetic pole array 105 and a plurality of fourth winding cores 108 in the fourth half magnetic pole array 106. In some embodiments, the third winding cores 107 and the fourth winding cores 108 are employed to provide grooves for wiring, and therefore the surfaces of the winding cores may not be coplanar with other portions of the magnetic core body.

For example, as shown in FIG. 3B, the third winding core 107 in the third half magnetic pole array 105 may have a top surface 107A that slightly lower than a top surface 105A of the third half magnetic pole array 105. Likewise, as shown in FIG. 3C, the fourth winding core 108 in the fourth half magnetic pole array 106 may have a bottom surface 108B slightly higher than a bottom surface 106B of the fourth half magnetic pole array 106. Like the space between the first half magnetic pole array 101 and the second half magnetic pole array 102 in the upper magnetic core body 100A, the space between the third half magnetic pole array 105 and the fourth half magnetic pole array 106 is used to arrange another metal plate set therein. In such embodiments, the third winding cores 107 and the fourth winding core 108 are both in contact with the metal plate set and therefore there is no height difference between the pole units 83 or 84 at the center of the lower magnetic core body 100B. Plan surfaces 86A and 86B may thereby be provided by the pole units 83 and 84, respectively, at the center of the lower magnetic core body 100B for entirely contacting the metal plate set.

Furthermore, in some embodiments, the first winding cores 103 and the fourth winding cores 108 are employed to provide starting points when winding a coil structure on the upper magnetic core body 100A and the lower magnetic core body 100B. To be more detailed, as shown in FIGS. 2B and 3C, in such embodiments, each of the first winding cores 103 and each of the fourth winding cores 108 comprise a semicircle end (i.e., 103C and 108C) and a flat end opposite to the semicircle end.

Figure 4A:
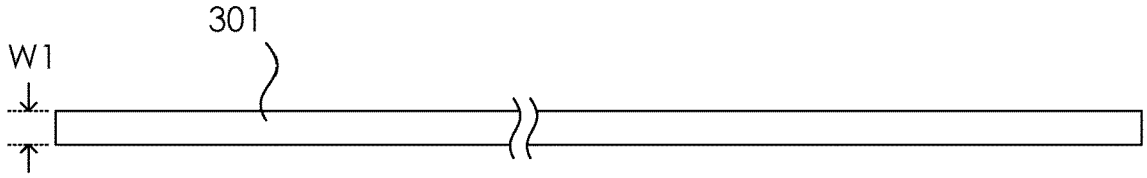
FIG. 4A illustrates a top view of a first superconductor tape according to some embodiments of the present disclosure.
Figure 4B:
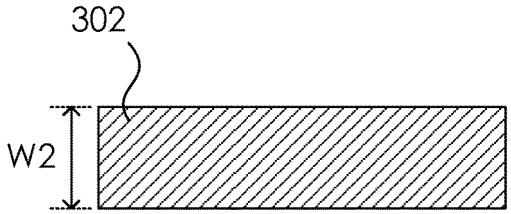
FIG. 4B illustrates a top view of a second superconductor tape according to some embodiments of the present disclosure.
Figure 4C:
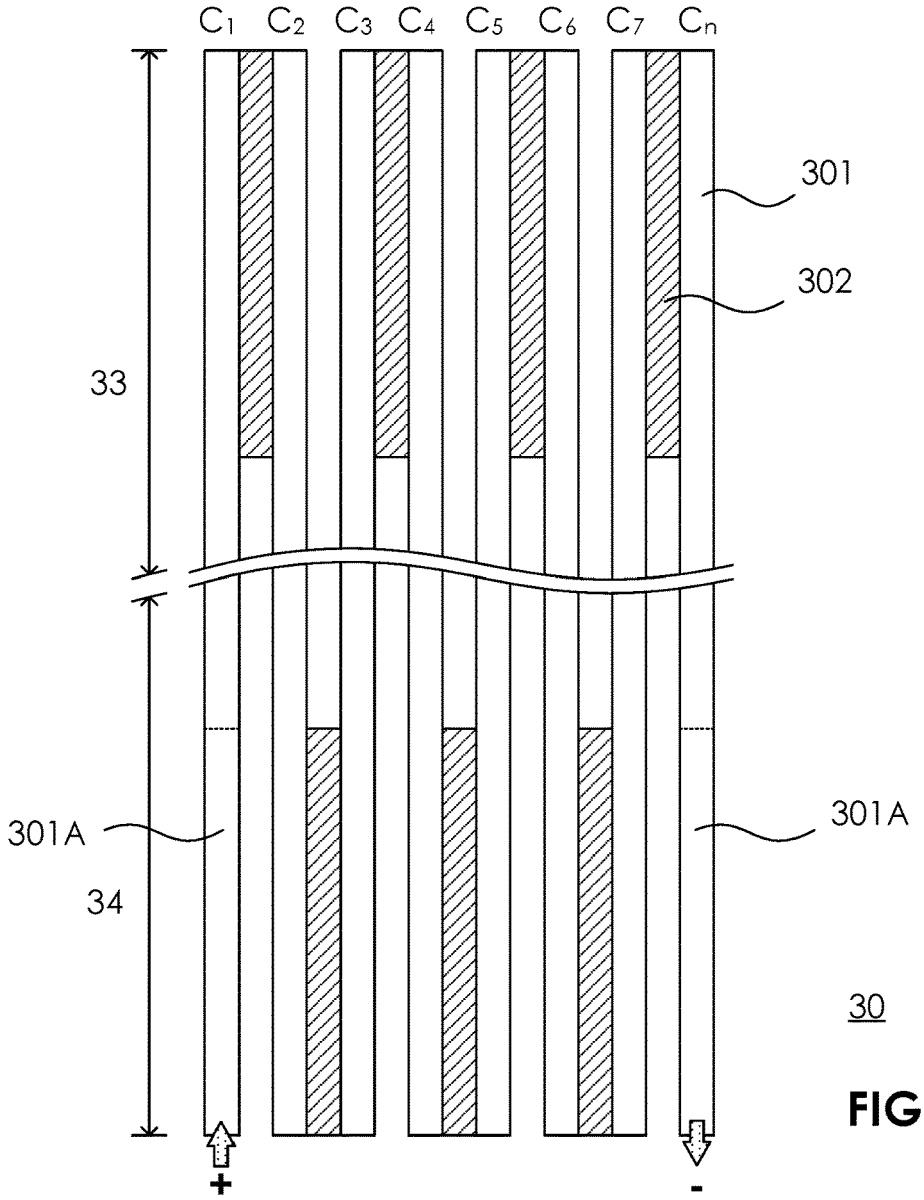
FIG. 4C illustrates a top view of a spread-out coil structure according to some embodiments of the present disclosure.

In some embodiments, a coil structure is used to wound on the winding cores of the magnetic core bodies as previously disclosed. As shown in FIGS. 4A to 4C, a coil structure 30 is disclosed. The coil structure 30 may include a plurality of first superconductor tapes 301 that in contact with a surface of each of the winding cores (e.g., the first and second winding cores 103 and 104), and a plurality of second superconductor tapes 302 that in contact with two adjacent first superconductor tapes. The coil structure 30 in the present disclosure includes a tape-shaped or a sheet-shaped structure instead of a wire structure having a circular cross-section or a rectangular cross-section. That is, the coil structure 30 in the present disclosure has a width that obviously greater than a thickness thereof. In some embodiments, the coil structure 30 includes superconductor material such as rare-earth barium copper oxide (REBCO). In some embodiments, the coil structure 30 superconductor tapes include a multilayer structure that at least a REBCO layer is included. In an example, the coil structure 30 includes a superconductor tape which has the REBCO layer, such superconductor tape has a thickness as about 0.1 mm and a width as about 4.0 mm.

Comparing to low-temperature superconductor material such as niobium-titanium (NbTi), the high-temperature superconductor (HTS) material such as REBCO may exhibit superconductivity at a comparative high temperature, for example, at about 77K. Accordingly, by using the coil structure 30 which has high-temperature superconductor material, the superconductor undulator module in the present disclosure may free from using cryogens, such as liquid helium.

In other words, the superconductor undulator module in the present disclosure is no longer restricted by liquid helium since the high-temperature condition 25K and the current density are achievable by using a cyro-cooler. However, the superconductor tapes made by REBCO cannot be bent freely, and therefore the superconductor tapes in the present disclosure do not simply wound on the magnetic core body like that by NbTi superconductor wires. To be more precise, as previously shown in FIGS. 2A and 3A, there are a plurality of winding cores within the half magnetic pole arrays, but a regular superconductor tape cannot be bent for switching among different winding cores. Accordingly, the present disclosure provides a novel approach to overcome the winding issue raised by the physical property of superconductor tapes.

As shown in FIG. 4A, in some embodiments, the first superconductor tape 301 is employed as a primary portion in the winding, thus the first superconductor tapes 301 may have a comparatively long length and a width W1 which is slightly smaller than to the width of the winding core. On the other hand, like the embodiment shown in FIGS. 4B and 4C, the second superconductor tape 302 is employed as a bridging portion and thus it may have a comparatively short length within a bridging region and a width W2 at least greater than two times of the width W1 of the first superconductor tape 301.

In some embodiments, the second superconductor tape 302 may be called a superconductor bridging plate. In some embodiments, the second superconductor tape 302 can be divided into a plurality of inner second superconductor tape and a plurality of outer second superconductor tape depends on the location of the second superconductor tape 302. The categorization of second superconductor tape 302 will be discussed later.

In some embodiments, each of the second superconductor tape 302 is in contact with two first superconductor tapes 301 that belong to two adjacent magnet coils, for example, as illustrated in FIG. 4C, the magnet coils $C_1$, $C_2$, $C_3$, . . . and $C_n$ can be electrically connected by the second superconductor tapes 302 and therefore a continuous coil structure is substantially formed. In fact, the second superconductor tape 302 is employed as a termination joint to electrically connect to the first superconductor tapes 301 of adjacent magnet coils, which means the first superconductor tapes 301 reverses in direction upon passage through the joint, and the plurality of first superconductor tapes 301 are entirely parallel to each other. Generally, the first superconductor tapes 301 are jointed to a number of the second superconductor tapes 302 (e.g., a plurality of inner superconductor tape portions 33) prior to being winding on the winding cores. As shown in FIG. 4C, in some embodiments, each of the first superconductor tapes 301 in proximity to two sides of the coil structure 30 may have a connecting section 301A free from in contact with the second superconductor tapes 302. The outer section 301A of the first superconductor tapes 301 may connect to a current source such as a power supply or other electronic devices. Furthermore, the coil structure 30 may further be divided into the inner superconductor tape portion 33 and an outer superconductor tape portion 34, wherein the inner superconductor tape portion 33 is the portion that mainly be wounded along the first, second, third, or the fourth winding cores 103, 104, 106, 107, whereas the outer superconductor tape portion 34 is the portion that mainly be placed at the sides of the upper magnetic core body 100A and the lower magnetic core body 100B.

As previously mentioned, the superconductor tapes made of REBCO cannot be bent freely. Therefore, in order to wound the first superconductor tapes 301 on the winding cores, the structures of the winding cores are designed to fit the physical property of the superconductor tapes. Referring to FIGS. 2A and 2B again, the first winding core 103 includes the semicircle end 103C. In some embodiments, the semicircle end 103C of the first winding core 103 has a radius of curvature greater than about 11 mm. That is, in the scenario that the radius of curvature of the winding core is greater than a specific threshold (i.e., the minimum bending radius of the superconductor tape), it is possible to slightly bend the first superconductor tape 301 to attach along the surfaces of the winding cores.

As shown in FIGS. 2A and 2B, because the first winding core 103 includes a flat end and both ends of the second winding core 104 are flat, the first superconductor tape 301 cannot properly attach to the surface near the right angles thereof due to its physical property. Therefore, in some embodiments of the present disclosure, a plurality of guiding components are provided to eliminate the right angles within the winding path.

Figure 5:
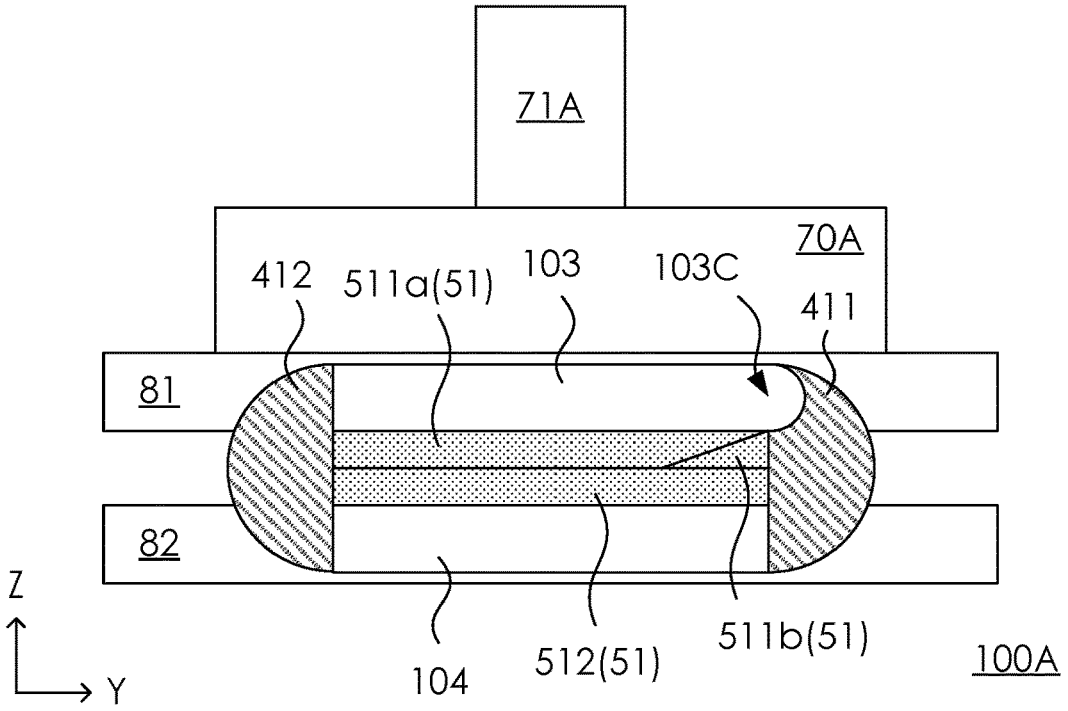
FIG. 5 illustrates a side view of an upper magnetic core body according to some embodiments of the present disclosure.

Referring to FIG. 5, which illustrates the structure feature of the winding cores and a plurality of guiding components by using the pole units 81, 82 in the upper magnetic core body 100A; in some embodiments, the superconductor undulator structure further includes a first guiding component 411 connected to the second winding core 104 and the semicircle end 103C of the first winding core 103. To be more precise, the first guiding component 411 is in contact with the entire semicircle end 103C of the first winding core 103 and one of the flat ends of the second winding core 104. Moreover, the superconductor undulator structure also includes a second guiding component 412 connected to the flat ends of the first winding core 103 and the second winding core 104, wherein both the flat ends thereof are entirely covered by the second guiding component 412. In some embodiments, both the first guiding component 411 and the second guiding component 412 have semicircle profiles, wherein these guiding components have radii of curvature greater than the minimum bending radius of the superconductor tape. In some embodiments, the shape of the first guiding component 411 is different to the shape of the second guiding component 412 because the first guiding component 411 has a recess for corresponding to the semicircle end 103C of the first winding core 103. In some embodiments, the thicknesses of the first guiding component 411 and the second guiding component 412 are either identical to or smaller than the thicknesses of the first winding core 103 and the second winding core 104. The guiding components 411, 412, 421 and 422 are made of copper, aluminum, alloys thereof, or the like. In some embodiments, the guiding components 411, 412, 421 and 422 are made of non-magnetic material.

The first guiding component 411 and the second guiding component 412 are configured to provide a continuous surface for winding the first superconductor tape 301 thereon. As shown in FIG. 5, the flat end of the first winding core 103 and the two flat ends of the second winding core 104 are covered by the guiding components, and the profiles of the winding cores are altered to a single racetrack shape for winding the superconductor tapes thereon.

Figure 6:
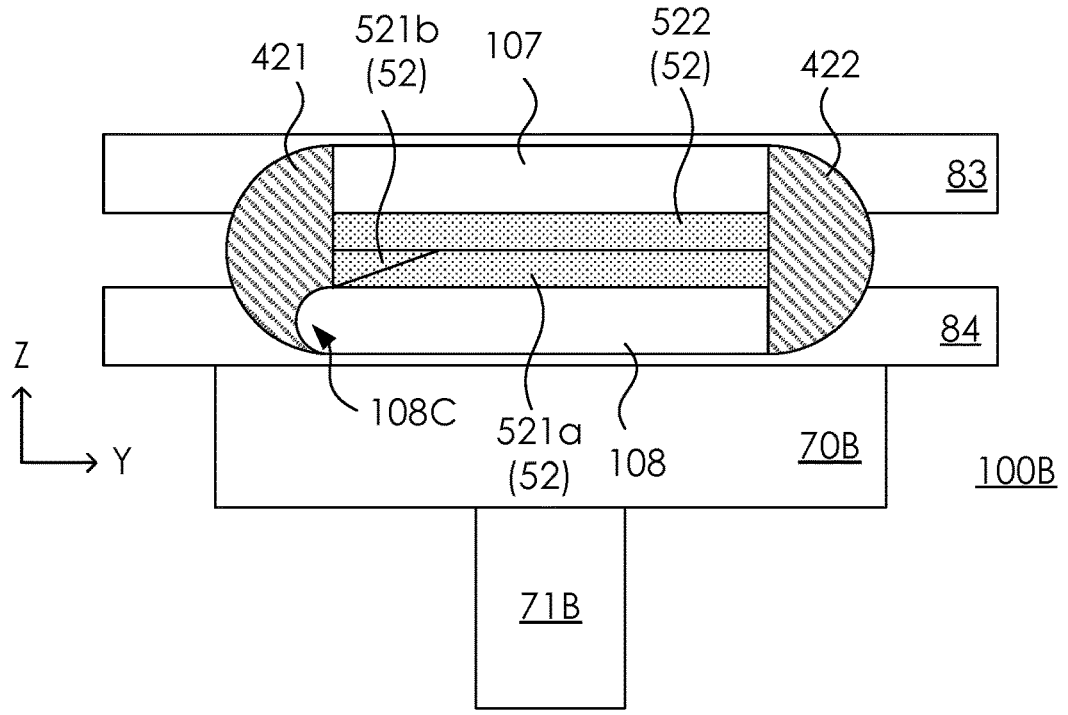
FIG. 6 illustrates a side view of a lower magnetic core body according to some embodiments of the present disclosure.

Referring to FIG. 6, which illustrates the structure feature of the winding cores and a plurality of guiding components by using the pole units 83, 84 in the lower magnetic core body 100B; like the embodiment shown in FIG. 5, the two flat ends of the third winding core 107 in FIG. 6 are covered by a first guiding component 421 and a second guiding component 422, while the flat end and the semicircle end 108C of the fourth winding core 108 are covered by the first guiding component 421 and the second guiding component 422, respectively. Like previously discussed, these guiding components can eliminate the right angles within the winding path, and thus the profiles of the winding cores in the lower magnetic core body 100B are also altered to a single racetrack shape for winding the superconductor tapes thereon.

Furthermore, the cooling components employed in the present disclosure are also illustrated in FIGS. 5 and 6. As shown in FIG. 5, a metal plate set 51 is sandwiched by the first half magnetic pole array (presented by the pole unit 81) and the second half magnetic pole array (presented by the pole unit 82) for cooling the superconductor tapes. In some embodiments, the metal plate set 51 includes a first metal plate that separated into a first portion 511*a* and a second portion 511*b*, and a second metal plate 512 stacked below the first metal plate. In some embodiments, the metal plate set 51 is made of copper. Similarly, as shown in FIG. 6, a metal plate set 52 is sandwiched by the third half magnetic pole array (presented by the pole unit 83) and the fourth half magnetic pole array (presented by the pole unit 84) for cooling the superconductor tapes. In some embodiments, the metal plate set 52 includes a first metal plate that separated into a first portion 521*a* and a second portion 521*b*, and a second metal plate 522 stacked below the first metal plate. In fact, the metal plate set 51 is substantially identical to the metal plate set 52. In some embodiments, an upper cooling bar 70A and a lower cooling bar 70B that connected to a cryo-cooler may be utilized to cool the upper magnetic core body 100A and the lower magnetic core body 100B by in contact therewith, while the upper cooling bar 70A and the lower cooling bar 70B are connected to an upper cooling channel 71A and a lower cooling channel 71B, respectively. In some embodiments, more cooling bars may be used to cool the coil structure 30, which will be described later.

In the present disclosure, the metal plate sets 51, 52 are cooled by using cryo-coolers, which is a cooling device that may reach cryogenic temperatures. Generally, the operating temperature of superconductor materials is performed by the combination of liquid helium and cryo-coolers, or by using liquid helium solely; however, since the superconductor tapes employed in the present disclosure are made of high-temperature superconductor material, it is expected that the less complex and inexpensive cooling structure (i.e., the cryo-coolers) can be employed thereby.

Figure 7A:
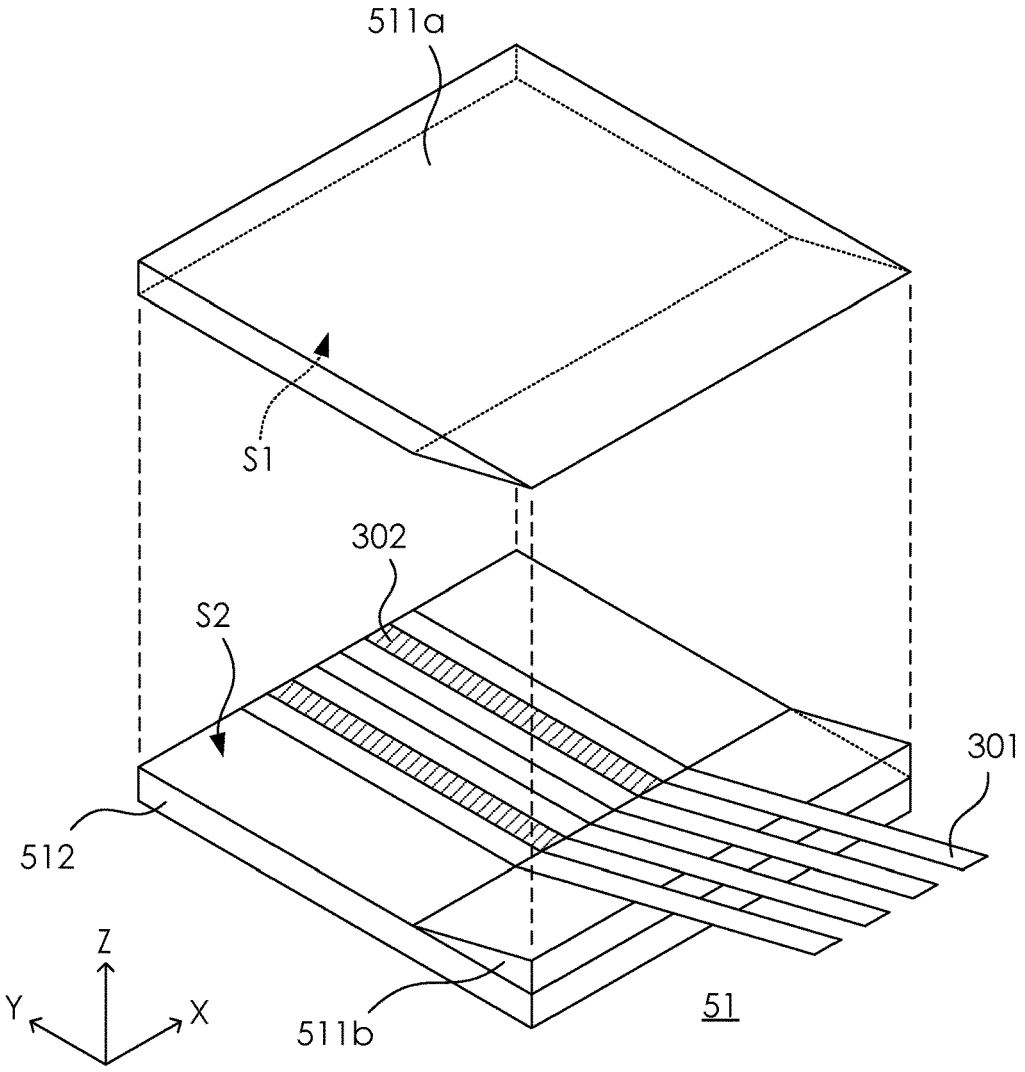
FIG. 7A illustrates an exploded three-dimensional illustration of a metal plate set according to some embodiments of the present disclosure.
Figure 7B:
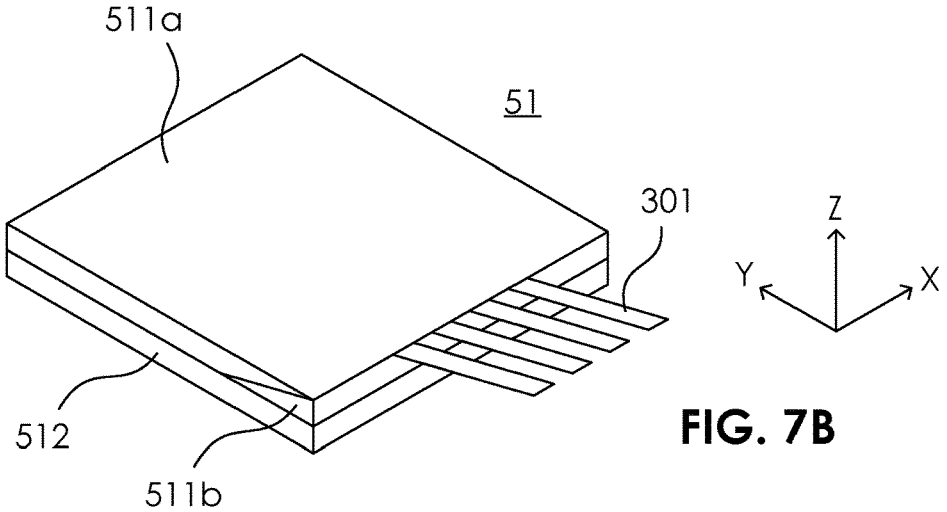
FIG. 7B illustrates a three-dimensional illustration of a metal plate set according to some embodiments of the present disclosure.

The structure feature of the metal plate sets 51, 52 are related to the winding technique disclosed in the present disclosure. Referring to FIGS. 7A and 7B, wherein FIG. 7A shows the exploded view of the metal plate set 51 in FIG. 7B, and several superconductor tapes are included for illustration. As shown in FIG. 7A, the first portion 511*a* of the first metal plate and the second metal plate 512 may include flat surfaces S1 and S2, respectively. These flat surfaces S1 and S2 are configured to in contact with the joint portions of the superconductor tapes because the joint portions of the superconductor tapes may heat during the operating so that the cooling concept in the present disclosure is focused on the joint portions of the superconductor tapes.

As previously illustrated and mentioned in FIG. 4C, each of the second superconductor tapes 302 is substantially employed as a termination joint to electrically connect to the first superconductor tapes 301 of adjacent magnet coils; therefore, in some embodiments, a first number of the second superconductor tapes 302 (or called inner second superconductor tapes) are entirely sandwiched by the flat surface S1 of the first metal plate and the flat surface S2 of the second metal plate 512. Such flatly sandwiched feature is different from the conventional technique because the joint portions of the superconductor tapes in a conventional undulator were used to be disposed at the turnaround structures of the winding cores.

On the other hand, by disposing the second superconductor tapes 302 on the abovementioned flat surfaces, it will be much effective in cooling the coil structure, and it is ensured that the use of cryogen such as liquid helium is completely avoidable.

In some embodiments, the metal plate set is made of copper. Moreover, the first metal plate of the metal plate set 51 can be divided into two portions. As shown in FIG. 7A, the second portion 511*b* is in proximity to a side of the metal plate set 51 and has a thickness increased gradually. The second portion 511*b* of the first metal plate is configured to guide the first superconductor tapes 301 to be wound on the semicircle end 103C of the first winding core 103, therefore, the first superconductor tapes 301 may smoothly pass the route between the metal plate set 51 and the first winding core 103.

Since the lower magnetic core body 100B is symmetric to the upper magnetic core body 100A, the structure features of the metal plate set 52 between the third half magnetic pole array 105 and the fourth half magnetic pole array 106 of the lower magnetic core body 100B is substantially identical to the metal plate set 51 and are omitted here for brevity.

Figure 8:
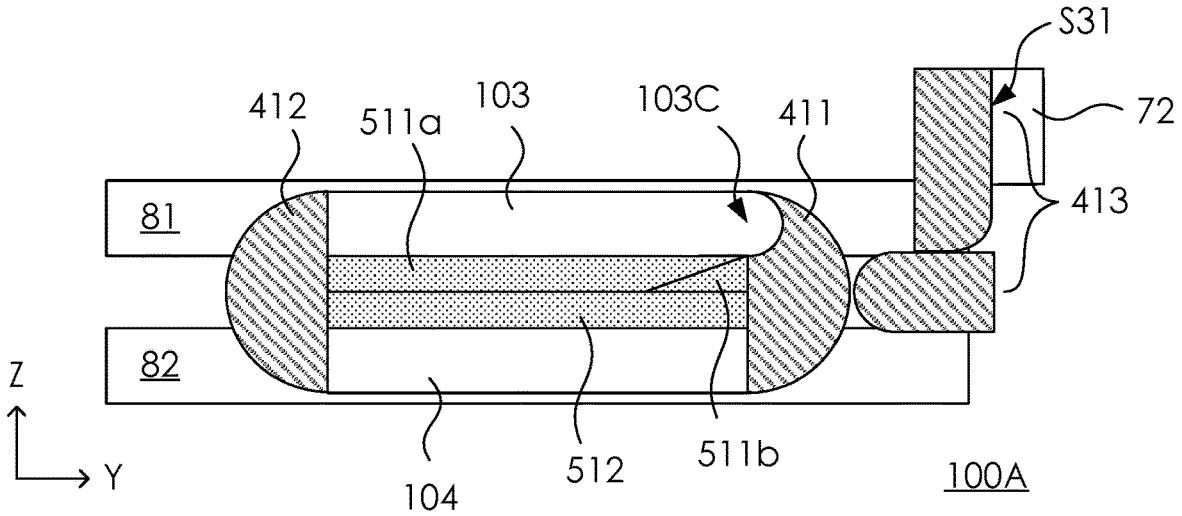
FIG. 8 illustrates a side view of an upper magnetic core body according to some embodiments of the present disclosure.

Referring to FIG. 8, in some embodiments, the superconductor undulator structure includes a third guiding component 413 in proximity to the first guiding component 411. The third guiding component 413 is configured to alter a direction of the first superconductor tape 301 extending from the first guiding component 411. The third guiding component 413 may provide a flat surface S31 as the flat surfaces S1, S2 in the metal plate set 51 previously disclosed in FIG. 7A.

In some embodiments, the flat surface S31 of the third guiding component 413 may be used to in contact with the outer superconductor tape portion 34 of the coil structure 30 winding on the upper magnetic core body 100A. The second superconductor tapes 302 within the outer superconductor tape portion 34 of the coil structure 30 are free from sandwiched by the metal plates of the metal plate sets 51, 52. That is, in some embodiment, the first number of the second superconductor tapes 302 (inner second superconductor tapes) are directly cooled by the metal plate sets 51, 52, while a second number of the second superconductor tapes 302 (or called outer second superconductor tapes) are spaced apart from the first half upper magnetic pole array 101 and the second half upper magnetic pole array 102 by the third guiding component 413. These second superconductor tapes 302 are in proximity to the flat surface S31 of the third guiding component 413 can be cooled by a third cooling bar 72, wherein the third cooling bar 72 is connected to the cryo-cooler as well. In some embodiments, the third guiding component 413 is made of copper and can be cooled by the cryo-coolers to maintain a suitable operating temperature to the first superconductor tape 301 and the second superconductor tape 302 thereon.

In some embodiments, the second superconductor tapes 302 free from covered by the metal plate set 51 are disposed at a side of the upper magnetic core body 100A due to the third guiding component 413. In some embodiments, the third guiding component 413 may have more than one curved portion to guide the direction of the first superconductor tapes 301 to perpendicular to the magnetic core body (100A or 100B), and each of the curved portions has a radius of curvature greater than about 11 mm to match the physical property of the superconductor tapes.

Figure 9A:
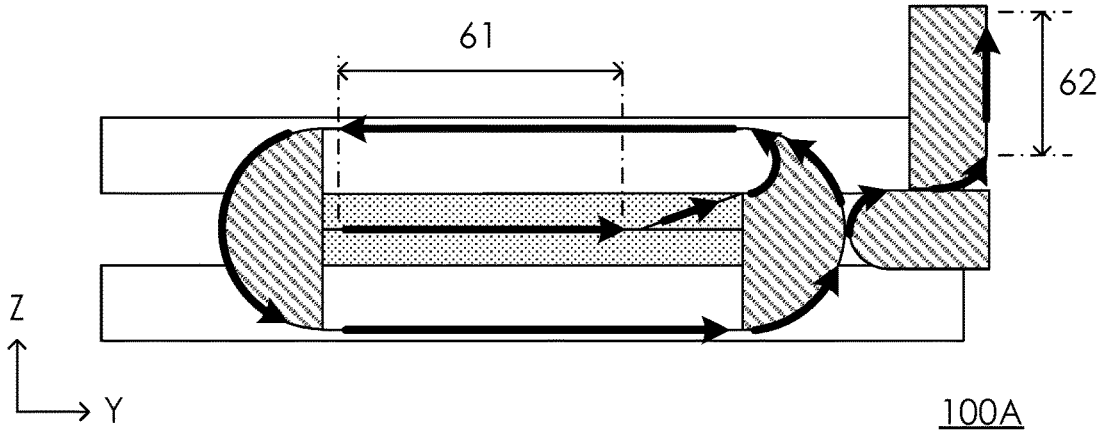
FIG. 9A illustrates a side view of an upper magnetic core body according to some embodiments of the present disclosure.
Figure 9B:
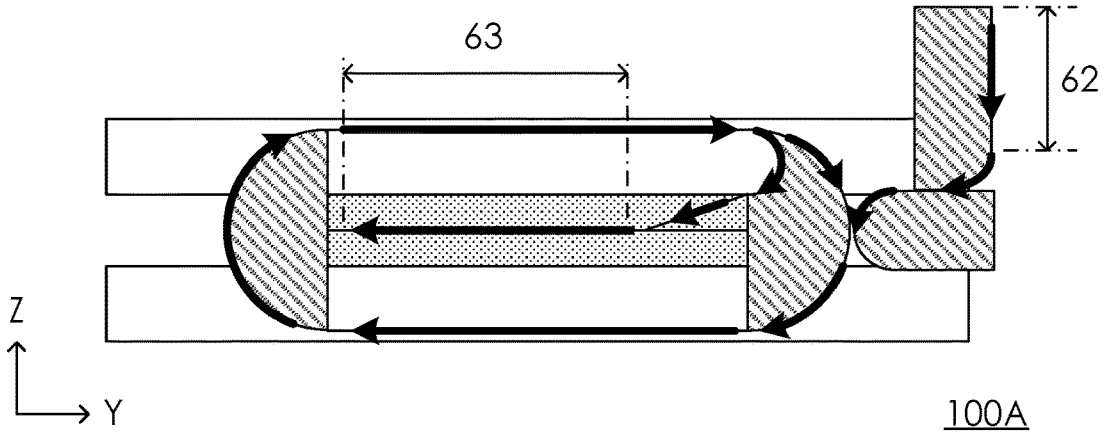
FIG. 9B illustrates a side view of an upper magnetic core body according to some embodiments of the present disclosure.

FIGS. 9A and 9B are used to illustrate the positions of the coil structure and the current direction (illustrated by arrows) in the superconductor undulator structure, wherein most of the reference signs of the structures are labeled in FIG. 8 and omitted in FIGS. 9A and 9B for brevity. In some embodiments of the present disclosure, the current is provided by a power supply continuously, which means the superconductor undulator structure does not operate under a built-in persistent current. Referring to FIG. 9A, by using one portion of the upper magnetic core body 100A as an example, the current may come from a first termination 61 (within the inner superconductor tape portion 33 previously shown in FIG. 4C) which has a second superconductor tape 302 therein, and the current may pass through the first superconductor tape 301 that wound along the route sequentially comprises: (a) the interface between the first portion 511*a* and the second portion 511*b* of the first metal plate; (b) the interface between the recess of the first guiding component 411 and the semicircle end 103C of the first winding core 103; (c) an upper surface of the first winding core 103; (d) a curved surface of the second guiding component 412; (e) a lower surface of the second winding core 104; and (f) a curved surface of the first guiding component 411. After winding the sections (c) to (f) for one or more times, the first superconductor tape 301 is further guided to a second termination 62 (within the outer superconductor tape portion 34 previously shown in FIG. 4C) by the guiding of the third guiding component 413. A second superconductor tape 302 is located at the second termination 62 to bridge another first superconductor tape 301 and make a turnaround of the current.

FIG. 9B illustrates another portion of the upper magnetic core body 100A that just adjacent to the one shown in FIG. 9A, and the superconductor tape in FIG. 9B is electrically connected to the superconductor tape in FIG. 9A through the second superconductor tape 302 located at the second termination 62, therefore, the current may come from the second termination 62 and pass through the first superconductor tape 301 that wound along the route sequentially comprises the aforementioned sections (f) to (a). A second superconductor tape 302 is located at the third termination 63 to bridge still another first superconductor tape 301 and make a turnaround of the current again, and so on.

Figure 10:
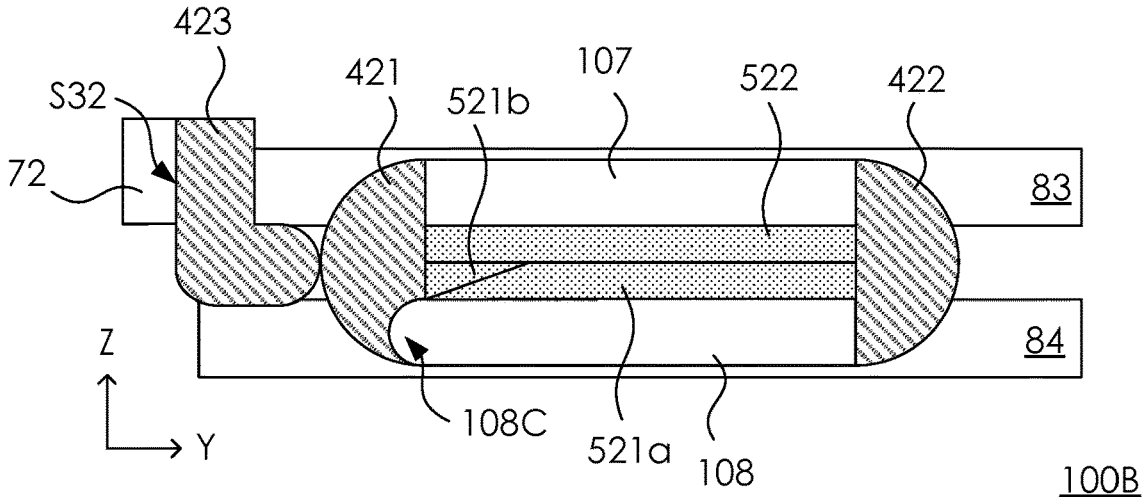
FIG. 10 illustrates a side view of a lower magnetic core body according to some embodiments of the present disclosure.

Referring to FIG. 10, in some embodiments, the superconductor undulator structure includes another third guiding component 423 in proximity to the first guiding component 421. The third guiding component 423 may provide another flat surface S32 for the entirely and flatly contact of the outer superconductor tape portion 34 of the coil structure 30 winding on the lower magnetic core body 100B. In some embodiments, the third guiding component 413 employed to the upper magnetic core body 100A is different from the third guiding component 423 employed to the lower magnetic core body 100B, because both the third guiding components 413 and 423 guide the first superconductor tapes 301 toward the upper side of the superconductor undulator module, and therefore even though the upper and lower portions of the superconductor undulator structure are almost symmetric, the structure of the third guiding components 413 and 423 should be different. In some embodiments, another third cooling bar 72 may be disposed in proximity to the flat surface S32 of the third guiding component 423 for cooling the outer superconductor tape portion 34 of the coil structure 30.

Figure 11A:
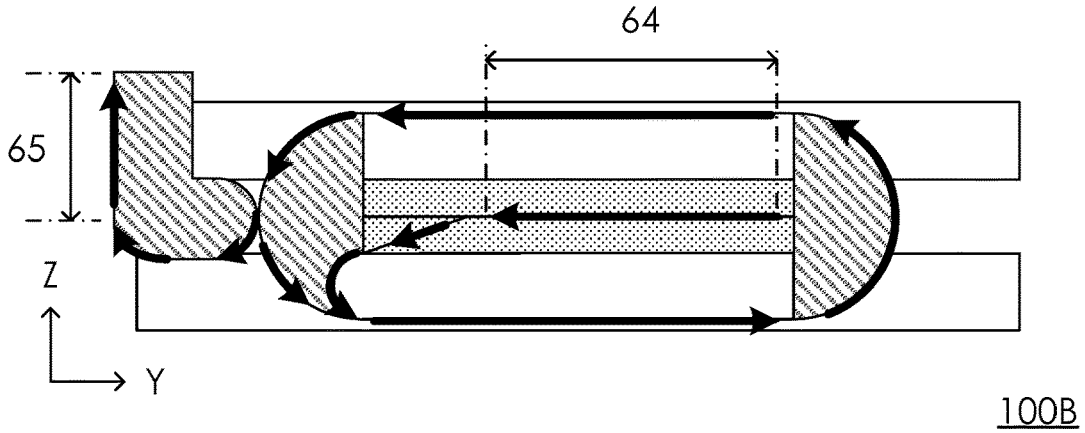
FIG. 11A illustrates a side view of a lower magnetic core body according to some embodiments of the present disclosure.
Figure 11B:
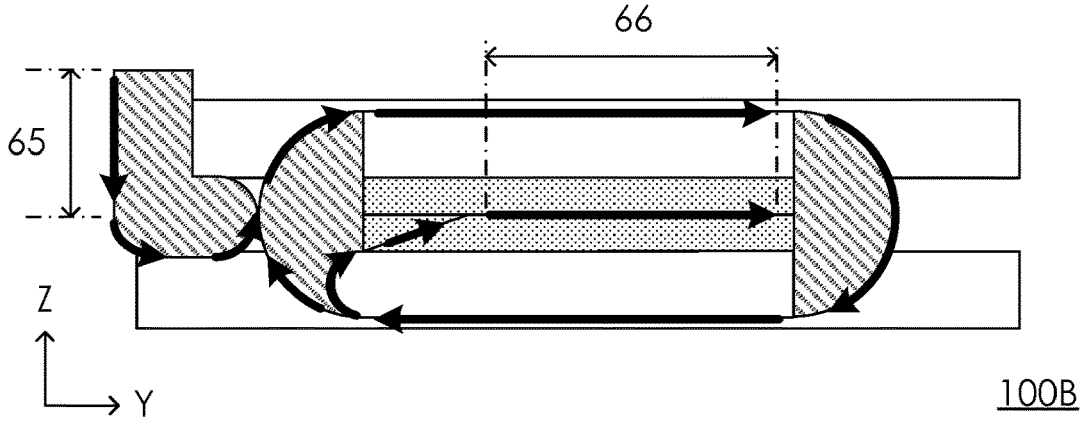
FIG. 11B illustrates a side view of a lower magnetic core body according to some embodiments of the present disclosure.

FIGS. 11A and 11B are used to illustrate the positions of the coil structure and the current direction in the superconductor undulator structure, wherein most of the reference signs of the structures are labeled in FIG. 10 and omitted in FIGS. 11A and 11B for brevity. Referring to FIG. 11A, by using one portion of the lower magnetic core body 100B as an example, the current may come from a fourth termination 64 which has a second superconductor tape 302 therein, and the current may pass through the first superconductor tape 301 that wound along the route similar with the route previously shown in FIG. 9A and is omitted here for brevity. The first superconductor tape 301 is further guided to a fifth termination 65 by the guiding of the third guiding component 423. A second superconductor tape 302 is located at the fifth termination 65 to bridge another first superconductor tape 301 and make a turnaround of the current.

FIG. 11B illustrates another portion of the lower magnetic core body 100B that just adjacent to the one shown in FIG. 11A, and the superconductor tape in FIG. 11B is electrically connected to the superconductor tape in FIG. 11A through the second superconductor tape 302 located at the fifth termination 65, therefore, the current may come from the fifth termination 65 and pass through the first superconductor tape 301 that wound along the route similar with the route previously shown in FIG. 9B. The first superconductor tape 301 is further guided to a sixth termination 66 by the guiding of the third guiding component 423. A second superconductor tape 302 is located at the sixth termination 66 to bridge still another first superconductor tape 301 and make a turnaround of the current again, and so on.

Figure 12A:
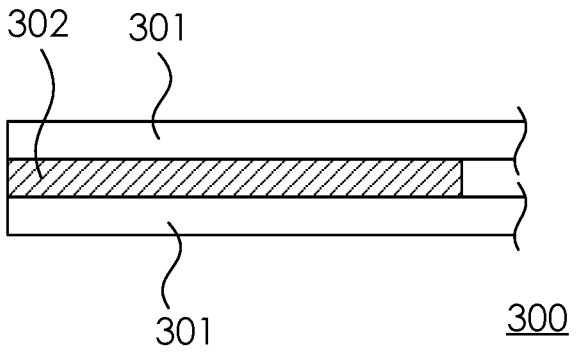
FIG. 12A illustrates a top view of a coil unit according to some embodiments of the present disclosure.

FIGS. 12A to 12C and 13A to 13C illustrate several operations for manufacturing the superconductor undulator structure in previously shown embodiments. Referring to FIG. 12A, a plurality of coil units 300 are formed prior to winding the superconductor tapes. In some embodiments, each of the coil units 300 includes two first superconductor tapes 301 attached to two edges of a second superconductor tape 302, respectively. Next, referring to FIG. 12B, the coil units 300 may be arranged over one of the metal plates of the metal plate set 51 (e.g., the second metal plate 512). The numbers of the coil units 300 arranged over the metal plate is depending on the numbers of the winding cores of the magnetic core body, whereas the numbers in FIG. 12B for illustration only. The plurality of coil units 300 is then be sandwiched by the metal plate set 51, wherein each of the first superconductor tapes 301 outwardly extends from a side of the metal plate set extended from a side of the metal plate set 51. Then, referring to FIG. 12C, a magnetic core body (e.g., the upper magnetic core body 100A) is received, wherein the magnetic core body includes a first half magnetic pole array 101 and a second half magnetic pole array 102 vertically aligned to the first half magnetic pole array 101. The metal plate set 51 with the plurality of coil units 300 therein is disposed between the first half magnetic pole array 101 and the second half magnetic pole array 102. Afterward, the first superconductor tapes 301 can be wound on the magnetic core body. The directions of the magnetic field are also labeled in FIG. 12C by using wide arrows.

Figure 12B:
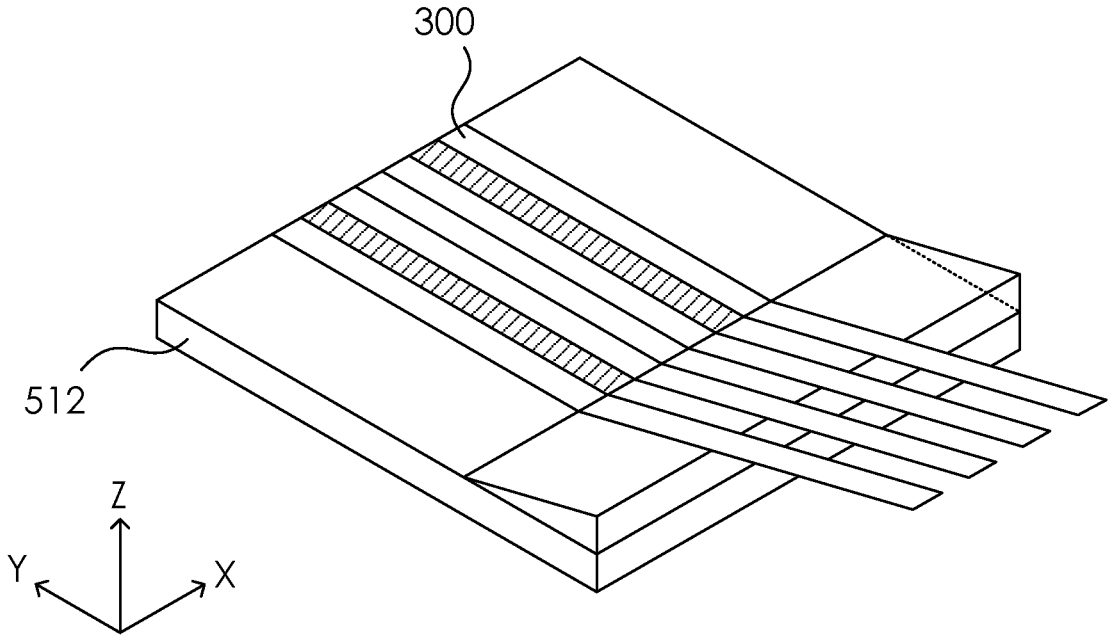
FIG. 12B illustrates a three-dimensional illustration of a metal plate and coil units thereon according to some embodiments of the present disclosure.
Figure 12C:
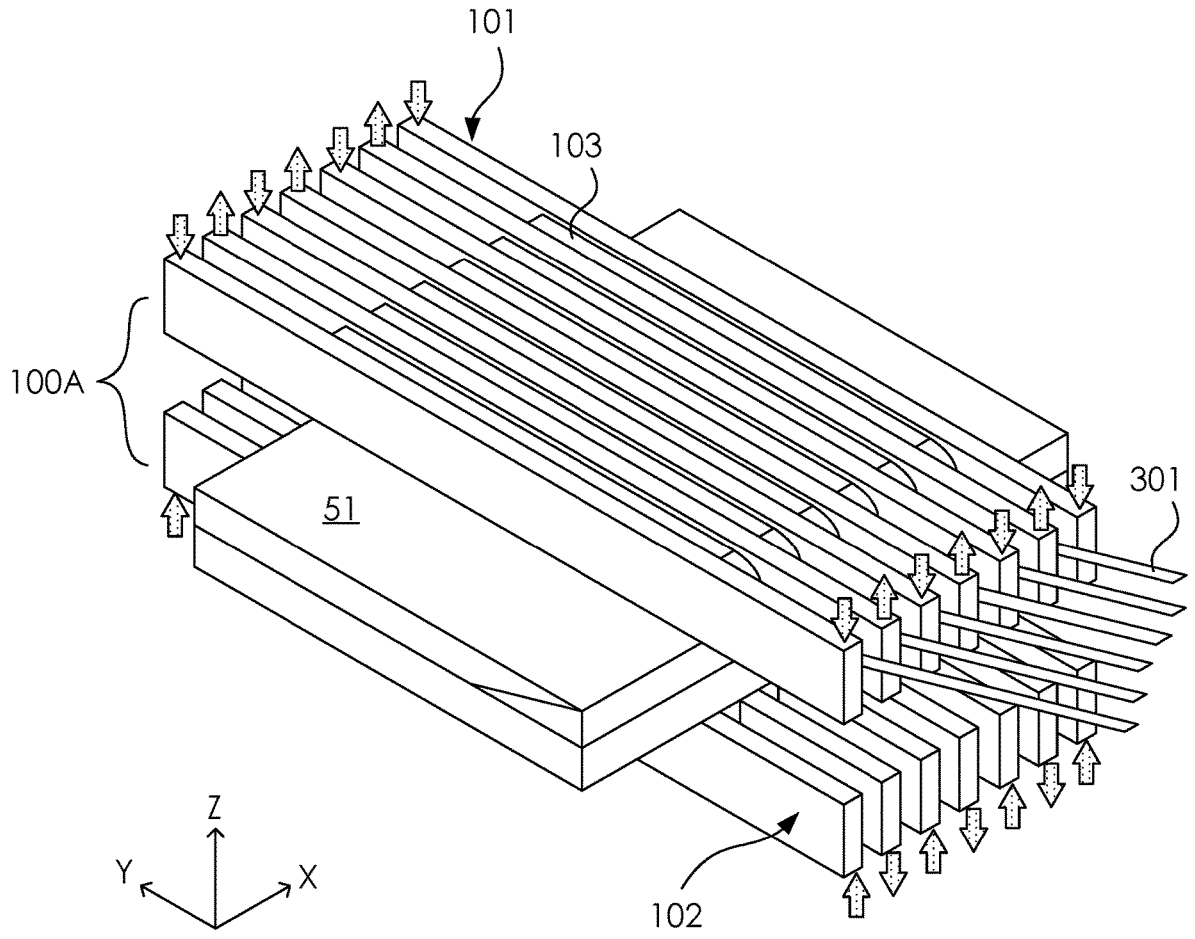
FIG. 12C illustrates a three-dimensional illustration of superconductor undulator structure according to some embodiments of the present disclosure.
Figure 13A:
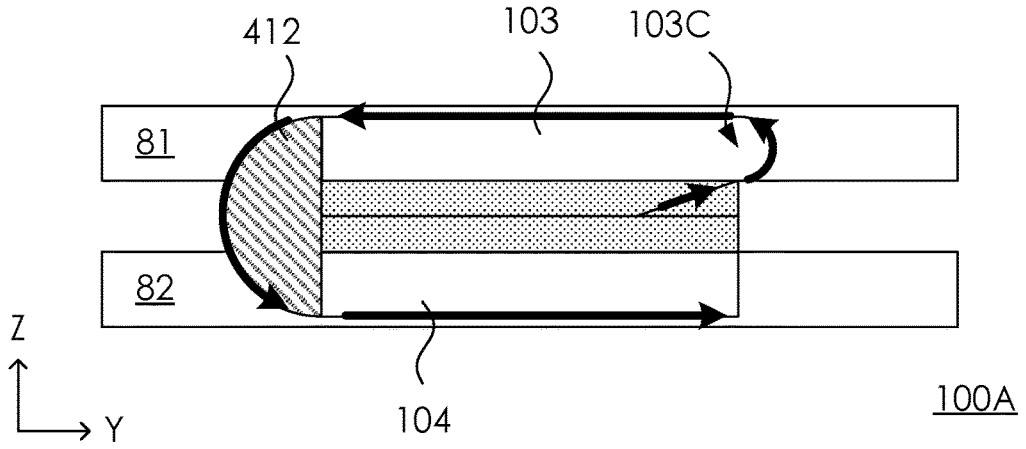
FIG. 13A illustrates a side view of an upper magnetic core body according to some embodiments of the present disclosure.
Figure 13B:
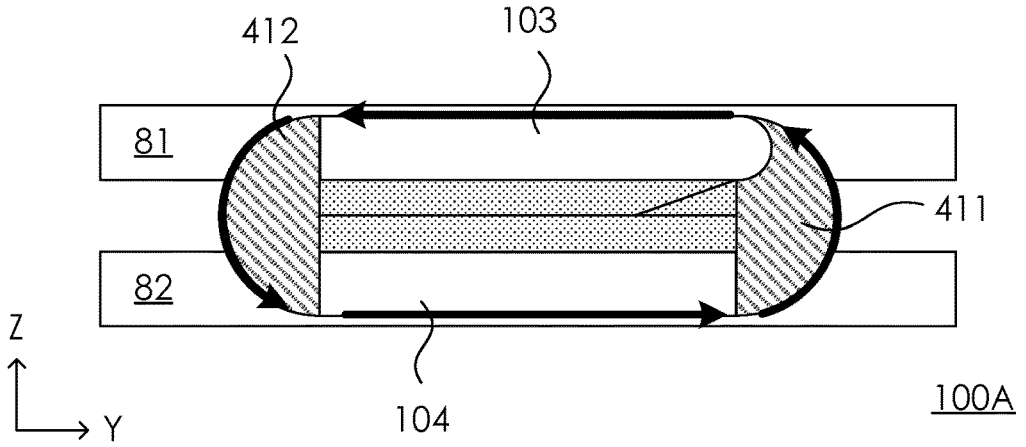
FIG. 13B illustrates a side view of an upper magnetic core body according to some embodiments of the present disclosure.
Figure 13C:
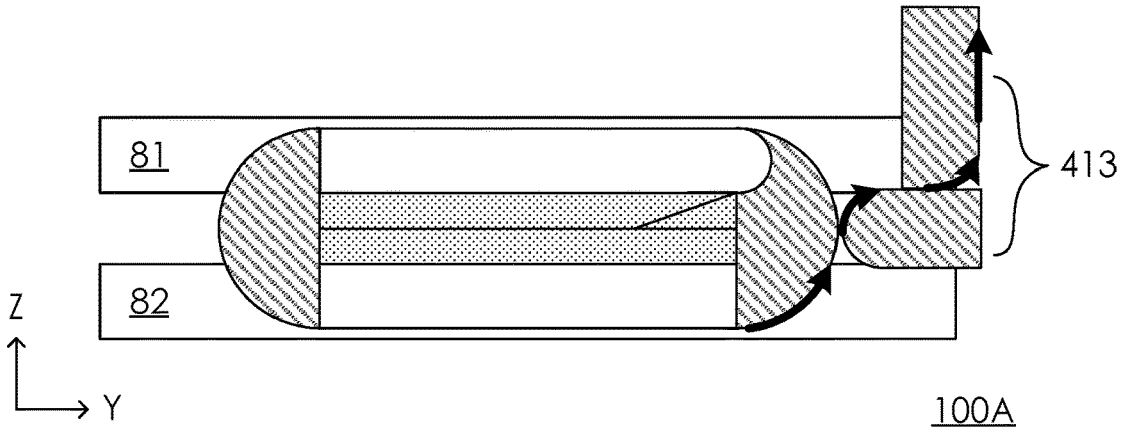
FIG. 13C illustrates a side view of an upper magnetic core body according to some embodiments of the present disclosure.

After the pre-winding operations shown in FIGS. 12A to 12C, the details of the winding disclosed in the present disclosure are illustrated in FIGS. 13A to 13C. Referring to FIG. 13A, the first superconductor tapes 301 (illustrated by arrows) may be wound along the semicircle end 103C of each of the first winding cores 103. Next, the first superconductor tapes 301 may be wound along an upper surface of each of the first winding cores 103, a curved surface of each of the second guiding components 412, and a lower surface of the each of the second winding cores 104, wherein each of the second guiding components 412 connects to a flat end of the first winding core 104. Then, referring to FIG. 13B, the first guiding component 411 is installed at the semicircle end 103C of each of the first winding cores 103, the semicircle end 103C is thus covered by the first guiding component 411. On the other hand, a racetrack shape is formed by the combination of the first guiding component 411, the first winding core 103, the second guiding component 412, and the second winding core 104, and the first superconductor tapes may wound on such racetrack-shaped winding structure one or more times. In addition, referring to FIG. 13C, the first superconductor tape 301 may further be wound along the third guiding component 413 in proximity to the first guiding component 411 to alter a direction of the first superconductor tape 301 extending from the first guiding component 411. Accordingly, the coil units 300 as previously shown in FIGS. 12A and 12B may be connected by jointing with other second superconductor tapes 302 at the third guiding component 413.

As illustrated in FIG. 11A and FIG. 13A, or the vertical comparison between FIG. 5 and FIG. 6, the coil structures 30 are wounded from the metal plate sets 51, 52 to the outer surfaces of the winding cores through the semicircle ends 103C and 108C, respectively, wherein the semicircle ends 103C and 108C are located at two opposite sides of the superconductor undulator module and distanced from the electron beam between the upper and lower magnetic core body 100A, 100B by the same distance. In other words, the magnetic field distribution provided by the superconductor undulator module is symmetric to the electron beam.

Briefly, according to the above-mentioned embodiments, the superconductor undulator disclosed in the present disclosure can free from using cryogen for cooling. Furthermore, since the cooling mechanism is altered in the present disclosure, the structure for winding is also improved to fulfill the physical property of high-temperature superconductor tape. Overall, compared to the conventional superconductor undulators, the superconductor undulator may have better performance and lower cost since no cryogen is used and the joint of the superconductor tapes is optimized to be located on the flat surfaces of the metal plates, and the effective in cooling should be improved significantly.

In one exemplary aspect, a superconductor undulator structure is provided. The superconductor undulator structure includes a magnetic core body and a coil structure. The magnetic core body includes a first half magnetic pole array and a second half magnetic pole array vertically aligned to the first half magnetic pole array; a plurality of first winding cores in the first half magnetic pole array; and a plurality of second winding cores in the second half magnetic pole array. The coil structure is wound on the first winding cores and the second winding cores of the magnetic core body. The coil structure includes a plurality of first superconductor tapes in contact with each of the first winding cores and each of the second winding cores; and a plurality of second superconductor tapes, each of the second superconductor tapes is in contact with two adjacent first superconductor tapes.

In another exemplary aspect, a superconductor undulator module is provided. The superconductor undulator module includes an upper magnetic core body, a coil structure, a metal plate set, and a lower magnetic core body. The upper magnetic core body has a first half upper magnetic pole array and a second half upper magnetic pole array vertically aligned to the first half upper magnetic pole array. The coil structure is wound on the upper magnetic core body. The metal plate set is sandwiched by the first half upper magnetic pole array and the second half upper magnetic pole array, and a portion of the coil structure is sandwiched by two metal plates of the upper metal plate set. The lower magnetic core body is in proximity to a bottom of the upper magnetic core body.

In yet another exemplary aspect, a method of manufacturing a superconductor undulator structure is provided. The method includes the following operations. A plurality of coil units are formed, and each of the coil units includes two first superconductor tapes attached to two edges of a second superconductor tape, respectively. The plurality of coil units are sandwiched by a metal plate set, wherein each of the first superconductor tapes outwardly extends from a side of the metal plate set. A magnetic core body is received. The magnetic core body comprises a first half magnetic pole array and a second half magnetic pole array vertically aligned to the first half magnetic pole array. The metal plate set is disposed between the first half magnetic pole array and the second half magnetic pole array. The first superconductor tapes are wound on the magnetic core body.

The foregoing outlines structures of several embodiments so that those skilled in the art may better understand the aspects of the present disclosure. Those skilled in the art should appreciate that they may readily use the present disclosure as a basis for designing or modifying other operations and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

What is claimed is:

1. A superconductor undulator structure, comprising:

a magnetic core body, comprising:

a first half magnetic pole array and a second half magnetic pole array vertically aligned to the first half magnetic pole array;

a plurality of first winding cores in the first half magnetic pole array; and a plurality of second winding cores in the second half magnetic pole array; and a coil structure wound on the first winding cores and the second winding cores of the magnetic core body, the coil structure comprises:

a plurality of first superconductor tapes in contact with each of the first winding cores and each of the second winding cores; and a plurality of second superconductor tapes, each of the second superconductor tapes is in contact with two adjacent first superconductor tapes.

2. The superconductor undulator structure of claim 1, wherein each of the first winding cores comprises a semicircle end and a flat end opposite to the semicircle end.

3. The superconductor undulator structure of claim 2, further comprising:

a first guiding component connected to the second winding core and the semicircle end of the first winding core; and a second guiding component connected to the second winding core and the flat end of the first winding core.

4. The superconductor undulator structure of claim 3, further comprising:

a third guiding component in proximity to the first guiding component, the third guiding component is configured to alter a direction of the first superconductor tape extending from the first guiding component.

5. The superconductor undulator structure of claim 1, wherein the plurality of first superconductor tapes are entirely parallel to each other.

6. The superconductor undulator structure of claim 1, wherein the plurality of first superconductor tapes and the plurality of second superconductor tapes comprise rare-earth barium copper oxide (REBCO).

7. The superconductor undulator structure of claim 1, further comprising:

a first metal plate and a second metal plate disposed between the first half magnetic pole array and the second half magnetic pole array;

wherein a number of the plurality of second superconductor tapes are flatly sandwiched by the first metal plate and the second metal plate.

8. The superconductor undulator structure of claim 1, wherein a width of the second superconductor tape is greater than two times of a width of the first superconductor tape.

9. The superconductor undulator structure of claim 2, wherein the semicircle end of the first winding core has a radius of curvature greater than a minimum bending radius of the first superconductor tape.

10. A superconductor undulator module, comprising:

an upper magnetic core body having a first half upper magnetic pole array and a second half upper magnetic pole array vertically aligned to the first half upper magnetic pole array;

a coil structure wound on the upper magnetic core body;

a metal plate set sandwiched by the first half upper magnetic pole array and the second half upper magnetic pole array, and a portion of the coil structure is sandwiched by two metal plates of the metal plate set; and a lower magnetic core body in proximity to a bottom of the upper magnetic core body.

11. The superconductor undulator module of claim 10, wherein the lower magnetic core body is symmetric to the upper magnetic core body.

12. The superconductor undulator module of claim 10, wherein the coil structure comprises:

a plurality of first superconductor tapes;

a plurality of second superconductor tapes, each of the second superconductor tapes is in contact with two adjacent first superconductor tapes;

wherein the two adjacent first superconductor tapes are in proximity to two edges of the second superconductor tape, respectively.

13. The superconductor undulator module of claim 12, wherein a first number of the plurality of second superconductor tapes are each entirely in contact with a flat surface of the metal plate.

14. The superconductor undulator module of claim 13, wherein a second number of the plurality of second superconductor tapes are spaced apart from the first half upper magnetic pole array and the second half upper magnetic pole array by a guiding component.

15. The superconductor undulator module of claim 10, wherein the upper magnetic core body further comprises a plurality of upper semicircle ends, and the lower magnetic core body comprises a plurality of lower semicircle ends, wherein the upper semicircle ends and the lower semicircle ends are located at two opposite sides of the superconductor undulator module, configured to make a magnetic field distribution provided by the superconductor undulator module is symmetric to an electron beam passing through.

16. A method of manufacturing a superconductor undulator structure, the method comprising:

forming a plurality of coil units, each of the coil units comprises two first superconductor tapes attached to two edges of a second superconductor tape, respectively;

sandwiching the plurality of coil units by a metal plate set, wherein each of the first superconductor tapes outwardly extends from a side of the metal plate set;

receiving a magnetic core body comprising a first half magnetic pole array and a second half magnetic pole array vertically aligned to the first half magnetic pole array;

disposing the metal plate set between the first half magnetic pole array and the second half magnetic pole array; and winding the first superconductor tapes on the magnetic core body.

17. The method of claim 16, wherein the magnetic core body further comprises a plurality of first winding cores in the first half magnetic pole array and a plurality of second winding cores in the second half magnetic pole array.

18. The method of claim 17, wherein the operation of winding the first superconductor tapes on the magnetic core body comprises:

winding the first superconductor tapes along a semicircle end of each of the first winding cores;

winding the first superconductor tapes along the first winding cores, a plurality of second guiding components, and the second winding cores, wherein each of the second guiding components connect to a flat end of the first winding core;

installing a first guiding component at the semicircle end of each of the first winding cores, the semicircle end is covered by the first guiding component; and winding the first superconductor tapes along the first guiding components.

19. The method of claim 18, further comprising:

winding the first superconductor tape along a third guiding component in proximity to the first guiding component to alter a direction of the first superconductor tape extending from the first guiding component; and connecting the coil units by other second superconductor tapes.

20. The method of claim 19, wherein the first guiding component, the first winding core, the second guiding component, and the second winding core are combined to a racetrack-shaped structure for winding the first superconductor tapes thereon for more than one time.

* * * * *